US011120749B2

(12) United States Patent
Lin et al.

(10) Patent No.: US 11,120,749 B2
(45) Date of Patent: Sep. 14, 2021

(54) DISPLAY DEVICE

(71) Applicant: AU Optronics Corporation, Hsin-Chu (TW)

(72) Inventors: Chun-Feng Lin, Hsin-Chu (TW); Kai-Wei Hong, Hsin-Chu (TW); Chuang-Cheng Yang, Hsin-Chu (TW); Yi-Cheng Lin, Hsin-Chu (TW); Ming-Hsien Lee, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 118 days.

(21) Appl. No.: 16/708,712

(22) Filed: Dec. 10, 2019

(65) Prior Publication Data

US 2020/0202795 A1 Jun. 25, 2020

(30) Foreign Application Priority Data

Dec. 25, 2018 (TW) ..... 107147026

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01)

(58) Field of Classification Search
CPC .. G09G 3/3208; G09G 3/3225; G09G 3/3233; G09G 3/3291
See application file for complete search history.

(56) References Cited

U.S. PATENT DOCUMENTS

| | | | | |
|---|---|---|---|---|
| 7,286,105 | B2 | 10/2007 | Akimoto et al. | |
| 2012/0120046 | A1* | 5/2012 | Senda | G09G 3/3225 345/211 |
| 2016/0163253 | A1* | 6/2016 | Chaji | G09G 3/3233 345/691 |
| 2019/0347990 | A1* | 11/2019 | Knez | G09G 3/3233 |

FOREIGN PATENT DOCUMENTS

| | | | |
|---|---|---|---|
| CN | 104599637 | A | 5/2015 |
| CN | 106847188 | A | 6/2017 |
| TW | I322404 | | 3/2010 |

* cited by examiner

*Primary Examiner* — Priyank J Shah
(74) *Attorney, Agent, or Firm* — WPAT, PC

(57) ABSTRACT

A display device includes a driving circuit and a control circuit. The driving circuit is configured to receive a data voltage in response to a scanning signal, and to control the brightness of a light emitting element according to the data voltage. The control circuit is configured to provide a stop signal to the driving circuit in response to a digital signal and the scanning signal, so as to stop the light emitting element from emitting light, and in turn control the light emission period of the light emitting element.

20 Claims, 8 Drawing Sheets

DRV

120

DISPLAY DEVICE

BACKGROUND OF THE INVENTION

1. Field of the Invention

This disclosure relates to an electrical device, in particular, a display device.

2. Description of the Prior Art

Along with the rapid development of electrical technology, display devices such as mobile phones and computers have been widely applied in our daily lives.

Generally speaking, a display device may include a gate drive circuit, a source drive circuit, and a pixel array circuit. The gate drive circuit may sequentially provide a plurality of gate signals to the pixel circuits, so as to sequentially switch on the switching transistors of the pixel circuits row by row. The source drive circuit may provide a plurality of data signals to the pixel circuits switched on by the switching transistors, so the pixel circuits may conduct display operations based on the data signals.

SUMMARY OF THE INVENTION

One aspect of the present invention relates to a display device. According to one embodiment of the present invention, a display device includes a driving circuit and a control circuit. The driving circuit is configured to receive a data voltage in response to a scanning signal, and control brightness of a light emitting element based on the data voltage. The control circuit is configured to provide a stop signal to the driving circuit in response to a digital signal and the scanning signal, so as to stop the light emitting element from emitting light, and in turn control the light emission period of the light emitting element.

Another aspect of the present invention relates to a display device. According to one embodiment of the present invention, a display device includes a light emitting element; a driving element electrically connected to an anode or a cathode of the light emitting element; a data switch electrically connected between a control terminal of the driving element and a data input terminal; a stop switch electrically connected between the control terminal of the driving element and a reset input terminal; a counting circuit, wherein one or more input terminals of the counting circuit are electrically connected to one or more digital signal input terminals; and an output circuit, wherein one or more input terminals of the output circuit are electrically connected to one or more output terminals of the counting circuit, and an output terminal of the output circuit is electrically connected to a control terminal of the stop switch.

By applying one of the embodiments described above, the control circuit may control the light emission period of a light emitting element. As a result, the display device may regulate light emission more precisely.

BRIEF DESCRIPTION OF THE DRAWINGS

To make the objects and advantages of the present invention described above easier to understand, the drawings will be briefly described below.

DETAILED DESCRIPTION OF THE PREFERRED EMBODIMENT

In the following specification, the invention will be described with reference to specific embodiments thereof. It will, however, be evident that various modifications and changes may be made thereto, without departing from the broader spirit and scope of the invention.

It should be understood that, the terms "first", "second", "third", etc. do not refer to a specific order or sequence, nor are they used to limit the present invention, but are merely used to distinguish elements or operations described with the same technical terms from each other.

The term "electrically connected" used in this disclosure may mean two or more elements being physically/electrically connected to each other directly or indirectly. The term "electrically connected" may further mean that two or more elements operate or interact with one another.

The terms "including," "comprising," "having," etc. are open terms that mean "including but not limited to."

The term "and/or" used herein includes any and all combinations of one or more of the associated listed items.

The terms "about," "approximate," etc. used in the present specification are used to modify a quantity which can tolerate a small amount of deviation or error, but such small amount of deviation or error do not change the nature of the quantity.

Unless otherwise defined, all terms (including technical and scientific terms) used herein have the same meaning as commonly understood by one of ordinary skill in the art to which the present invention belongs. Some terms will be described in the following text or other places in this disclosure to provide extra guidance to the person ordinarily skilled in this art.

Figure 1:
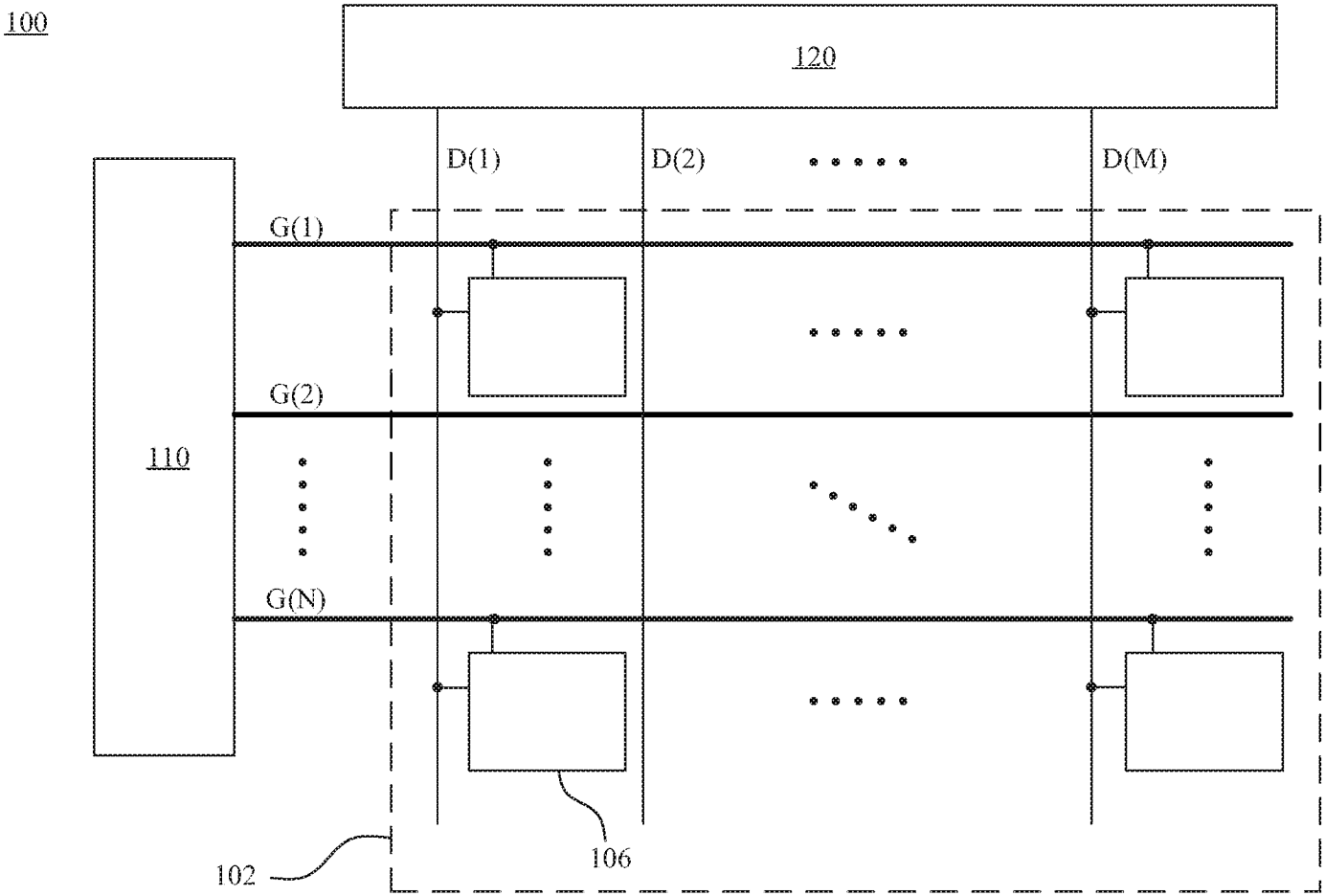
FIG. 1 illustrates a schematic view of a display device according to one embodiment of the present invention.

FIG. 1 illustrates a schematic view of a display device 100 according to one embodiment of the present invention. Display device 100 may include gate drive circuit 110, source drive circuit 120, and pixel array 102. The pixel array 102 may include a plurality of pixel circuits 106 that are arranged in an array. The gate drive circuit 110 may sequentially generate and provide a plurality of scanning signals G(1), . . . , G(N) to the pixel circuits 106 in the pixel array 102, so as to switch on the data switches of the pixel circuits 106 (such as the switch T1 illustrated in FIG. 3), wherein N is a natural number. In one embodiment, the scanning signals G(1), . . . , G(N) are sequentially delayed by one line time (such as the time span of period D1 illustrated in FIG. 5). The source drive circuit 120 may generate a plurality of data signals D(1), . . . , D(M) and provide them, through a plurality of data lines, to pixel circuits 106 that are switched on by data switches, causing the pixel circuits 106 to conduct light emitting operation or display operation based on the data signals D(1), . . . , D(M), wherein M is a natural number.

Figure 2:
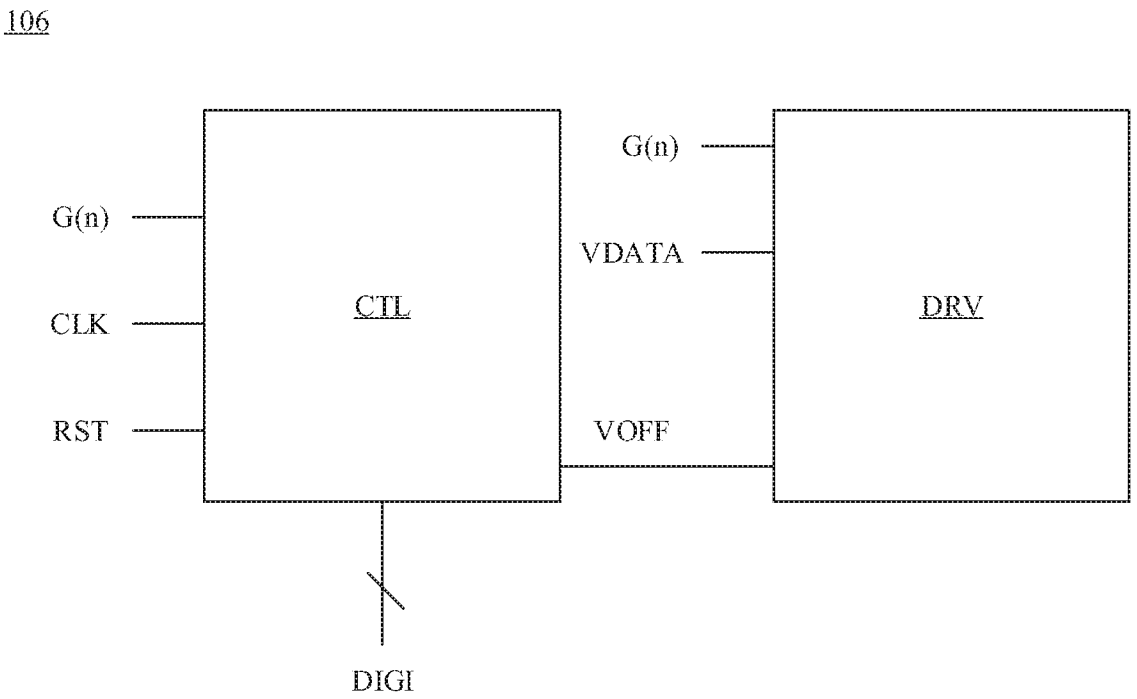
FIG. 2 illustrates a schematic view of a control circuit and a driving circuit according to one embodiment of the present invention.

Refer to FIG. 2. In one embodiment of the present invention, a pixel circuit 106 includes a control circuit CTL and a driving circuit DRV. In one embodiment, one of the data signals D(1), . . . , D(M) includes the data voltage VDATA and the digital signal DIGI, but the present invention is not limited hereto.

In one embodiment, the driving circuit DRV is configured to receive the data voltage VDATA in response to the scanning signal G(n), and control the brightness of a light emitting element (such as the light emitting element LT illustrated in FIG. 3) based on the data voltage VDATA, wherein signal G(n) is one of the scanning signals G(1), . . . , G(N) described above. In one embodiment, the control circuit CTL is configured to provide the stop signal VOFF to the driving circuit DRV based on the digital signal DIGI and the scanning signal G(n), so as to stop the light emitting element described above from emitting light, and in turn control the light emission period of the light emitting element. In one embodiment, the control circuit CTL determines the timing for the stop signal VOFF to be provided to the driving circuit DRV based on the digital signal DIGI and the scanning signal G(n).

Through the operation described above, the driving circuit DRV may control the brightness and light emission period of light emitting elements based on the data voltage VDATA and the stop signal VOFF respectively, so regulation of light emission may be more precise.

In some applications, in the case that the light emitting element described above is a mini LED, since the slope of the IV curve will be large, a small change in voltage will lead to a huge change in current. As a result, it is difficult to regulate the light emission of a light emitting element by controlling the voltage or current of a LED.

In one embodiment of the present invention, the light emission of a light emitting element may be regulated effectively by controlling the light emission period of the light emitting element described above with the stop signal VOFF.

For example, if the brightness of a light emitting element is 1200 nit per second when the voltage across the light emitting element is a specific value, the display device 100 may control the light emitting element to emit light in half of the time span of every frame, and not to emit light in the other half, so the brightness perceived by human eye is approximately 600 nit per second.

In one embodiment, the control circuit CTL may perform counting operation based on the clock signal CLK, so as to determine the timing for the stop signal VOFF to be provided to the driving circuit DRV. In one embodiment, the control circuit CTL may determine an initial counting value based on the digital signal DIGI, so as to determine the timing for the stop signal VOFF to be provided to the driving circuit DRV.

For example, the control circuit CTL may determine that the initial counting value is 9 based on the received and loaded digital signal DIGI, and perform counting operation based on the initial counting value and the clock signal CLK. In every cycle of the clock signal CLK, the counting value increases by 2. When the counting value reaches 31, the control circuit CTL may output the stop signal VOFF to the driving circuit DRV.

In one embodiment, the control circuit CTL may start counting based on the corresponding scanning signal G(n), so as to determine the timing for the stop signal VOFF to be provided to the driving circuit DRV. In one embodiment, the control circuit CTL may load the digital signal DIGI based on the corresponding scanning signal G(n), and perform counting operation based on the loaded digital signal DIGI, so as to determine the timing for the stop signal VOFF to be provided to the driving circuit.

For example, the control circuit CTL may load the digital signal DIGI when the corresponding scanning signal G(n) is received, and start counting (based on the loaded digital signal DIGI) after the corresponding scanning signal G(n) is over.

In one embodiment, the control circuit CTL may determine the timing for the stop signal VOFF to be outputted based on the period of the clock signal CLK. In one embodiment, the period of the clock signal CLK may be 2 line times, but the present invention is not limited hereto. In one embodiment, the clock signal CLK of the control circuit CTL may be the same as the clock signal CLK (of the gate drive circuit 110) that is used to generate the scanning signals G(1), . . . , G(N), but the present invention is not limited hereto.

In one embodiment, the control circuit CTL may also output the stop signal VOFF based on the reset signal RST, so as to perform reset operations.

In one embodiment of the present invention, the control circuit CTL and the driving circuit DRV may be applied in the backlight module of the display device 100, but the present invention is not limited hereto. In different embodiments, the control circuit CTL and the driving circuit DRV may also be applied in an active type display device, such as an AMOLED display device.

Figure 3:
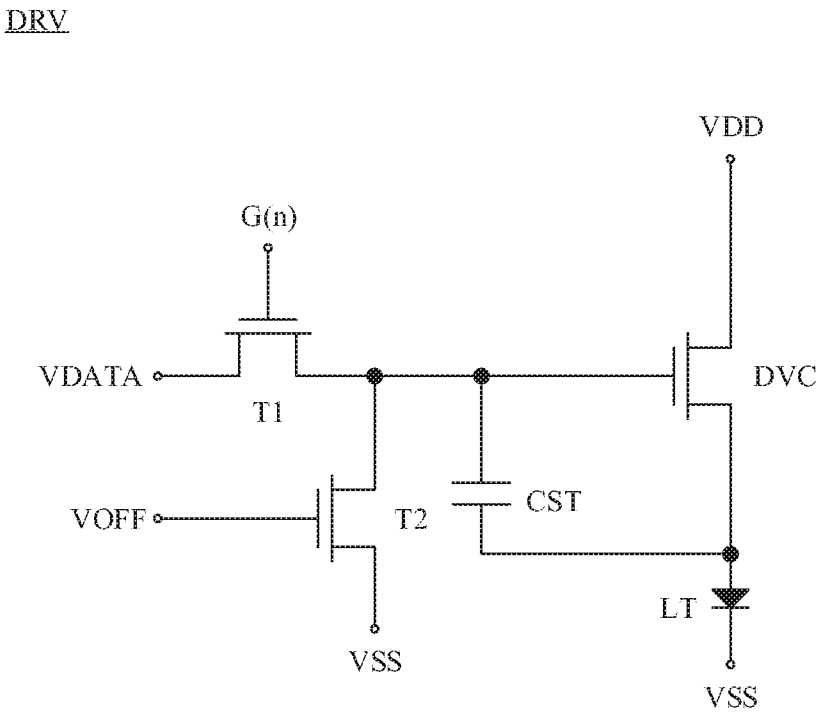
FIG. 3 illustrates a schematic view of a driving circuit according to one embodiment of the present invention.

Refer to FIG. 3. In one embodiment of the present invention, the driving circuit DRV may include the switches T1 and T2, the driving element DVC, the capacitor CST, and the light emitting element LT.

In one embodiment, the anode of the light emitting element LT is electrically connected to the first terminal of the driving element DVC, and the cathode of the light emitting element LT is configured to receive the supply voltage VSS. The second terminal of the driving element DVC is configured to receive the supply voltage VDD. The switch T1 (also referred to as the data switch in this disclosure) is electrically connected between the data input terminal that is configured to receive the data voltage VDATA and the control terminal of the driving element DVC. The control terminal of the switch T1 is electrically connected to the scanning signal input terminal that is configured to receive the scanning signal G(n). The switch T2 (also referred to as the stop switch in this disclosure) is electrically connected between the reset input terminal that is configured to receive the supply voltage VSS and the control terminal of the driving element DVC. The control terminal of the switch T2 is electrically connected to the stop signal input terminal that is configured to receive the stop signal VOFF. The capacitor CST is electrically connected between the first terminal and the control terminal of the driving element DVC.

In this embodiment, the switch T1 is configured to switch on in response to the scanning signal G(n), so as to provide the data voltage VDATA to the control terminal of the driving element DVC, causing the driving element DVC to drive (based on the data voltage VDATA) the light emitting element LT to emit light. In this embodiment, the switch T2 is configured to switch on in response to the stop signal VOFF, so as to provide the supply voltage VSS to the control terminal of the driving element DVC, causing the driving element DVC to stop driving the light emitting element LT.

Figure 8:
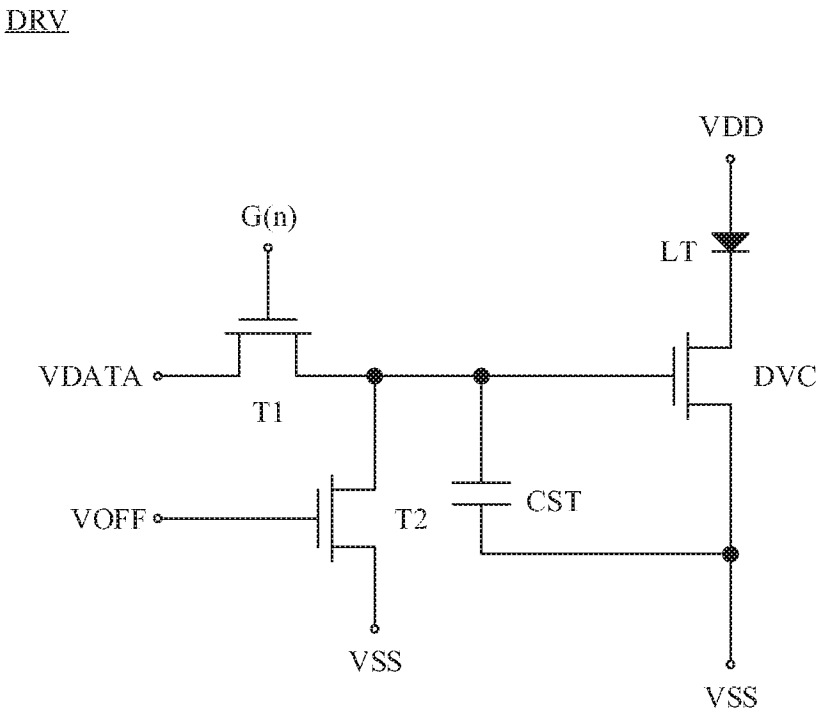
FIG. 8 illustrates a schematic view of a driving circuit according to another embodiment of the present invention.

It should be noted that, in different embodiments, the driving circuit DRV may have a different structure, and the present invention is not limited to the embodiment described above. For example, referring to FIG. 8, in an altered embodiment, the driving circuit DRV may be altered such that the cathode of the light emitting element LT is electrically connected to the driving element DVC, and the anode of the light emitting element LT is configured to receive the supply voltage VDD. Other details are given above and are not repeated here.

Figure 4:
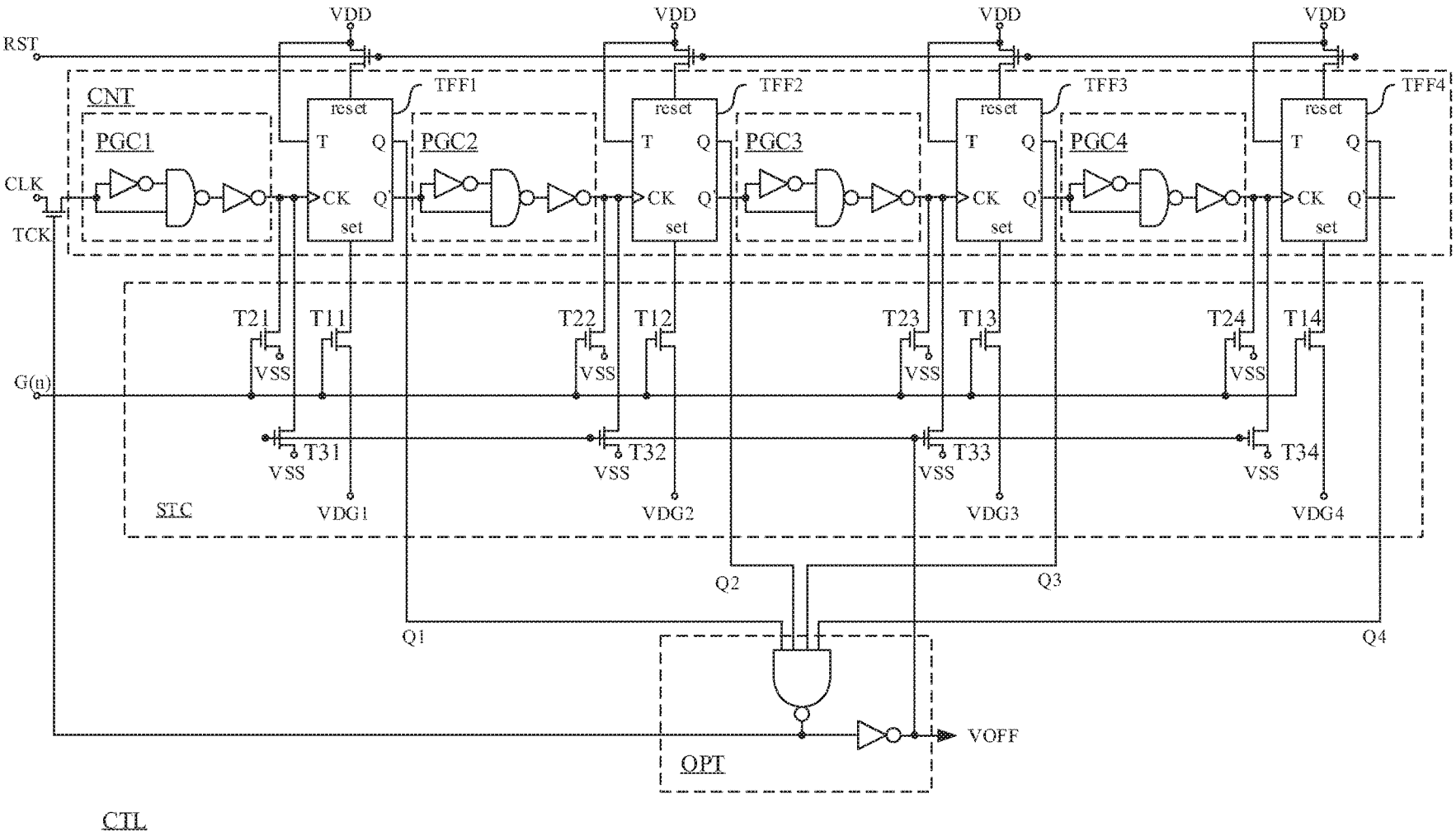
FIG. 4 illustrates a schematic view of a control circuit according to one embodiment of the present invention.

Refer to FIG. 4. In the following description, an example in which the digital signal DIGI has four bit signals VDG1-VDG4 are given to describe the present invention; however, the present invention is not limited thereto. In this embodiment, the control circuit CTL may determine the timing for the stop signal VOFF to be provided to the driving circuit DRV, based on the bit signals VDG1-VDG4.

In one embodiment, the control circuit CTL includes the counting circuit CNT, the output circuit OPT, and the setting circuit STC. In some embodiments, the setting circuit STC may be omitted or replaced depending on actual needs.

In one embodiment, the counting circuit CNT is configured to load the digital signal DIGI, generate the counting signals Q1-Q4 (corresponding to the counting value described above), and perform counting operations. In one embodiment, the counting circuit CNT may be triggered by the clock signal CLK to start counting.

In one embodiment, the output circuit OPT is configured to determine whether to generate the stop signal VOFF based on the counting signals Q1-Q4. For example, when the counting signals Q1-Q4 are all "1", the output circuit OPT generates the stop signal VOFF; however, the present invention is not limited hereto. Other forms of configurations are within the scope of the present invention.

In addition, the output circuit OPT is also configured to determine whether to stop the counting circuit CNT from counting, based on the counting signals Q1-Q4. For example, when the counting signals Q1-Q4 are all "1", the output circuit OPT may stop the counting circuit CNT from receiving the clock signal CLK; however, the present invention is not limited hereto. Other forms of configurations are within the scope of the present invention.

In one embodiment, the setting circuit STC is configured to provide bits of the digital signal DIGI to the counting circuit CNT, based on the scanning signal G(n). In other words, the setting circuit STC is configured to provide the bit signals VDG1-VDG4 to the counting circuit CNT based on the scanning signal (n), so as to make the counting circuit CNT load the bit signals VDG1-VDG4 and perform counting operations based on the bit signals VDG1-VDG4, generating the counting signals Q1-Q4.

In one embodiment, the setting circuit STC is also configured to provide disable signals to the counting circuit CNT based on the scanning signal G(n), so as to stop the counting circuit CNT from performing counting operations. In one embodiment, the disable signal may be provided, for example, to clock the input terminal of the counting circuit CNT and functions as a blank period signal. In one embodiment, the disable signal may be, for example, the supply voltage VSS, but is not limited hereto.

In one embodiment, the setting circuit STC is also used to provide the disable signal to the counting circuit CNT based on the stop signal VOFF, so as to stop the counting circuit CNT from performing counting operations. In one embodiment, the disable signal may be provided, for example, to the clock input terminal of the counting circuit CNT and functions as a blank period signal. In one embodiment the disable signal may be, for example, the supply voltage VSS, but is not limited hereto.

In one embodiment, the counting circuit CNT includes a plurality of flip-flops TFF1-TFF4 and a plurality of impulse generating circuits PGC1-PGC4. In one embodiment, the flip-flops TFF1-TFF4 are electrically connected in series staggeredly to the impulse generating circuits PGC1-PGC4.

For example, the input terminal of the impulse generating circuit PGC1 is configured to receive the clock signal CLK, and the output terminal of the impulse generating circuit PGC1 is electrically connected to the clock input terminal of the flip-flop TFF1. The input terminal of the impulse generating circuit PGC2 is electrically connected to the output terminal Q' (also referred to as the output terminal Q bar) of the flip-flop TFF1, and the output terminal of the impulse generating circuit PGC2 is electrically connected to the clock input terminal of the flip-flop TFF2. The input terminal of the impulse generating circuit PGC3 is electrically connected to the output terminal Q' of the flip-flop TFF2, and the output terminal of the impulse generating circuit PGC3 is electrically connected to the clock input terminal of the flip-flop TFF3. The input terminal of the impulse generating circuit PGC4 is electrically connected to the output terminal Q' of the flip-flop TFF3, and the output terminal of the impulse generating circuit PGC4 is electrically connected to the clock input terminal of the flip-flop TFF4.

In one embodiment, the flip-flops TFF1-TFF4 may be implemented with toggle flip-flops, but are not limited hereto. In one embodiment, the input terminals T of the flip-flops TFF1-TFF4 receive the supply voltage VDD; the set terminals of the flip-flops TFF1-TFF4 are configured to respectively receive the bit signals VDG1-VDG4; and the output terminals Q of the flip-flops TFF1-TFF4 are configured to respectively output the counting signals Q1-Q4 to the output circuit OPT. In other words, the counting signals Q1-Q4 received by the output circuit OPT include output signals that are respectively generated by the flip-flops TFF1-TFF4.

In one embodiment, the impulse generating circuits PGC1-PGC4 are configured to generate impulse signals based on the rising edges of the clock signal CLK and the rising edges of the output Q' of the flip-flops TFF1-TFF3, and respectively provide these impulse signals to the flip-flops TFF1-TFF4. In one embodiment, each of the impulse generating circuits PGC1-PGC4 includes two NOT gates and one NAND gate, but the present invention is not limited hereto.

In one embodiment, the output circuit OPT may include a NAND gate connected in series with a NOT gate, but the present invention is not limited hereto. In this embodiment, input terminals of the NAND gate (of the output circuit OPT) are respectively configured to receive the counting signals Q1-Q4. In the situation where all of the counting signals Q1-Q4 are "1"s, the NAND gate will output a "0" to the NOT gate, causing the NOT gate to output a "1" (which is the stop signal VOFF).

On the other hand, the control circuit CTL further includes the switch TCK. One terminal of the switch TCK is configured to receive the clock signal CLK; another terminal of the switch TCK is electrically connected to the output terminal of the impulse generating circuit PGC1. In the situation where all of the counting signals Q1-Q4 are "1"s, the NOT gate outputs a "0" to the control terminal of the switch TCK, so as to switch off the switch TCK, stopping counting circuit CNT from receiving the clock signal CLK.

In one embodiment, the setting circuit STC includes switches T11-T14 (also referred to as first switches in this disclosure), switches T21-T24 (also referred to as second switches in this disclosure), and switches T31-T34 (also referred to as third switches in this disclosure). In one embodiment, the switches T11-T14 are electrically connected between the bit signal input terminals that are configured to respectively receive the bit signals VDG1-VDG4 and the setting terminals of the flip-flops TFF1-TFF4, and the control terminals of the switches T11-T14 are configured to receive the scanning signal G(n). In one embodiment, the switches T11-T14 are configured to respectively switch on based on the scanning signal G(n), so as to respectively provide the bit signals VDG1-VDG4 to the flip-flops TFF1-TFF4.

In one embodiment, the switches T21-T24 are electrically connected between the disable signal input terminals (that are configured to respectively receive disable signals such as the supply voltage VSS) and the clock signal input terminals of the flip-flops TFF1-TFF4, and the control terminals of the switches T21-T24 are configured to receive the scanning signal G(n). In one embodiment, the switches T21-T24 are configured to respectively switch on based on the scanning signal G(n), so as to respectively provide disable signals (such as the supply voltage VSS) to clock signal input terminals of the flip-flops TFF1-TFF4, with the disable signals functioning as blank period signals.

In one embodiment, the switches T31-T34 are electrically connected between the disable signal input terminals (that are configured to respectively receive disable signals such as the supply voltage VSS) and the clock signal input terminals of the flip-flops TFF1-TFF4, and the control terminals of the switches T21-T24 are configured to receive the stop signal VOFF. In one embodiment, the switches T31-T34 are configured to respectively switch on based on the stop signal VOFF, so as to respectively provide disable signals (such as the supply voltage VSS) to clock the signal input terminals of the flip-flops TFF1-TFF4, with the disable signals functioning as blank period signals.

Figure 5:
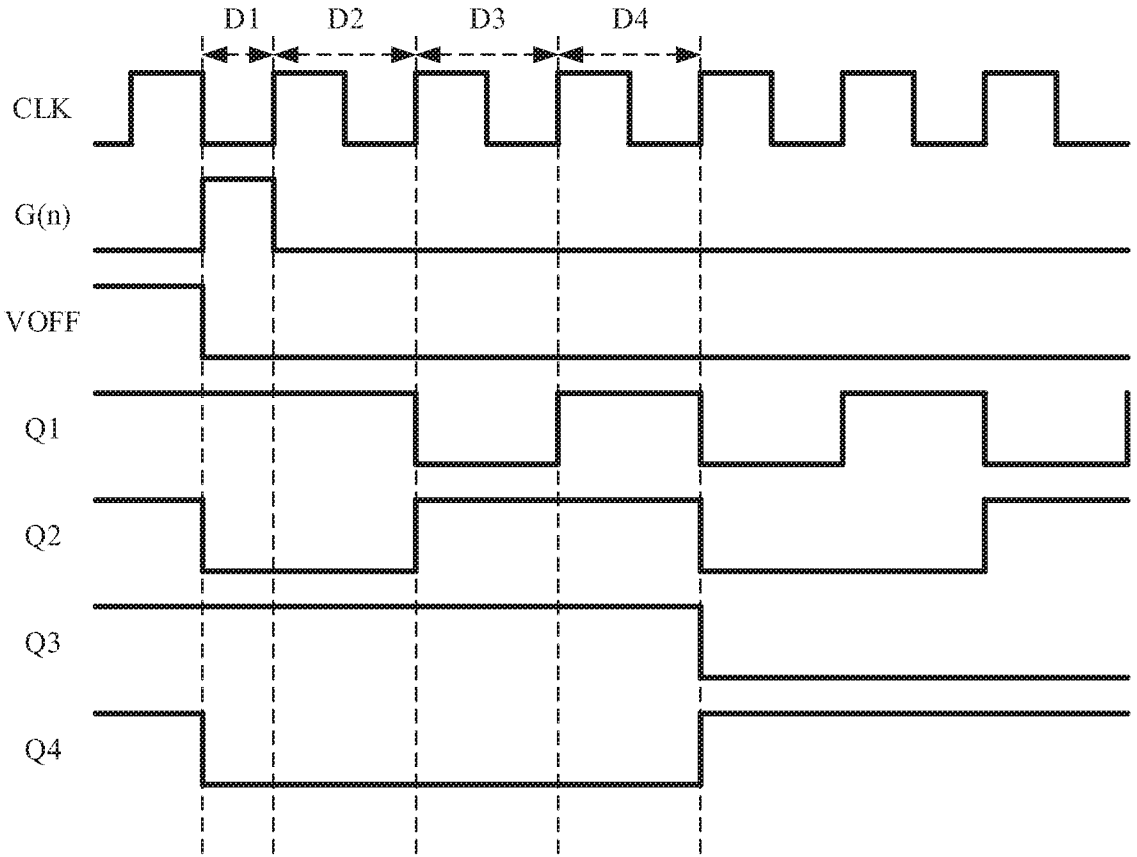
FIG. 5 illustrates a schematic view of signals of a control circuit according to one operation example of the present invention.

In the following description, details of an operation example of the present invention will be described with reference to FIGS. 4-5. Nevertheless, the present invention is not limited thereto.

In this operation example, bit signals VDG1-VDG4 are respectively given as "0", "1", "0" and "1", but the present invention is not limited hereto.

In period D1, the switches T11-T14 respectively switch on based on the scanning signal G(n), so as to respectively provide bit signals VDG1-VDG4 to the flip-flops TFF1-TFF4. The switches T21-T24 respectively switch on based on the scanning signal G(n), so as to respectively provide blank period signals to the flip-flops TFF1-TFF4.

At this time, counting signals outputted by output terminals Q of the flip-flops TFF1-TFF4 are, in a sequence corresponding to the initial counting values described above, "1", "0", "1", and "0". In other words, the corresponding binary number of the counting signals Q4-Q1 (which is "0101") can be converted to the decimal number "5".

At this time, based on the counting signals Q1-Q4, the output circuit OPT does not output the stop signal VOFF, and the output circuit OPT switches on the switch TCK so as to enable the clock signal CLK to be provided to the counting circuit CNT.

In period D2, the scanning signal G(n) ends, and the switches T11-T14 and T21-T24 switch off. At this time, the counting signals Q1-Q4 maintain respectively as "1", "0", "1", and "0".

In the period D3, the flip-flops TFF1-TFF4 are triggered by the clock signal CLK to change the states of the counting signals Q1 and Q2. At this time, the counting signals Q1-Q4 are "0", "1", "1", and "0" respectively. In other words, the corresponding binary number of the counting signals Q4-Q1 (which is "0110") can be converted to the decimal number "6".

In period D4, the flip-flops TFF1-TFF4 are triggered by the clock signal CLK to change the state of the counting signal Q1. At this time, the counting signals Q1-Q4 are "1", "1", "1", and "0" respectively. In other words, the corresponding binary number of the counting signals Q4-Q1 (which is "0111") can be converted to the decimal number "7".

As such, the corresponding number of the counting signals Q4-Q1 will continue to count up until it reaches "1111".

At this time, the output circuit OPT outputs the stop signal VOFF based on the counting signals Q1-Q4, so as to cause the driving circuit DRV to stop the light emitting element LT from emitting light. The switches T31-T34 respectively switch on based on the stop signal VOFF, so as to respectively provide blank signals to the flip-flops TFF1-TFF4. The switch TCK switches off in response to the stop signal VOFF, so as to stop the clock signal CLK from being provided to the counting circuit CNT.

Through the operation described above, in the situation where the period of the clock signal CLK is 2 line times, the driving circuit DRV may be controlled by the control circuit CTL to emit light for 21 line times in one frame. Similarly, if the bit signals VDG1-VDG4 are "1", "1", "0", and "1" respectively, the driving circuit DRV may be controlled by the control circuit CTL to emit light for 23 line times in one frame.

In one embodiment, the corresponding relationship between the bit signals VDG1-VDG4 and the light emission period is shown in the following table; nevertheless, the present invention is not limited thereto.

| VDG1 | VDG2 | VDG3 | VDG4 | line times |
|---|---|---|---|---|
| 0 | 0 | 0 | 0 | 1 |
| 1 | 0 | 0 | 0 | 3 |
| 0 | 1 | 0 | 0 | 5 |
| 1 | 1 | 0 | 0 | 7 |
| 0 | 0 | 1 | 0 | 9 |
| 1 | 0 | 1 | 0 | 11 |
| 0 | 1 | 1 | 0 | 13 |
| 1 | 1 | 1 | 0 | 15 |
| 0 | 0 | 0 | 1 | 17 |
| 1 | 0 | 0 | 1 | 19 |
| 0 | 1 | 0 | 1 | 21 |
| 1 | 1 | 0 | 1 | 23 |
| 0 | 0 | 1 | 1 | 25 |
| 1 | 0 | 1 | 1 | 27 |
| 0 | 1 | 1 | 1 | 29 |
| 1 | 1 | 1 | 1 | 31 |

It should be noted that, although the digital signal DIGI is described as having 4 bits in the embodiment described above, the number of bits of the digital signal DIGI may be adjusted depending on actual needs. For example, the number of bits of the digital signal DIGI may be adjusted to 1, 2, 3, 5, or more, and the numbers of the flip-flops, impulse generating circuits, first switches, second switches, and third switches in the control circuit CTL, and the NAND gates in the output circuit OPT, will be adjusted correspondingly, so the present invention is not limited to the embodiment described above.

Figure 6:
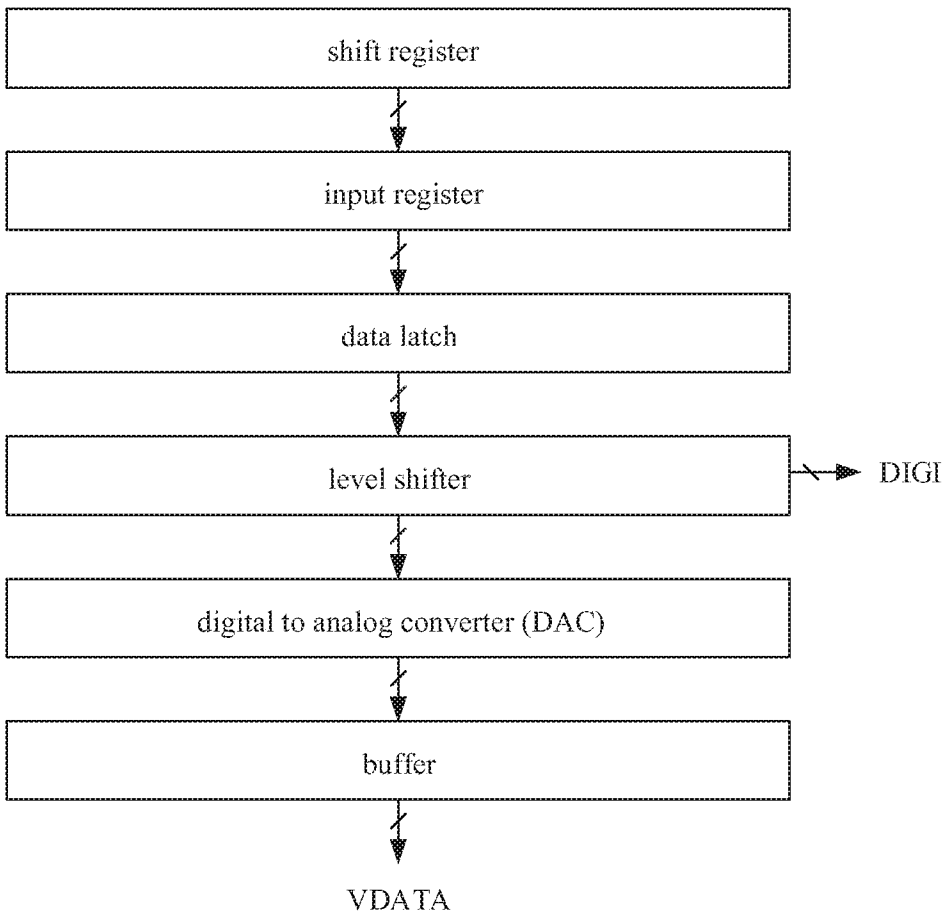
FIG. 6 illustrates a schematic view of a source driving circuit according to one embodiment of the present invention.

Refer to FIG. 6. In one embodiment of the present invention, source drive circuit 120 may be configured to provide the digital signal DIGI described above. For example, the source drive circuit 120 may provide the aforesaid digital signal DIGI with a level shifter electrically connected between a data latch and a digital to analog converter (DAC). In other embodiments, the source drive circuit 120 may use digital circuits such as shift registers, input registers configured to receive gray level data, or the aforesaid data latches to provide the digital signal DIGI; however, the present invention is not limited hereto.

Figure 7:
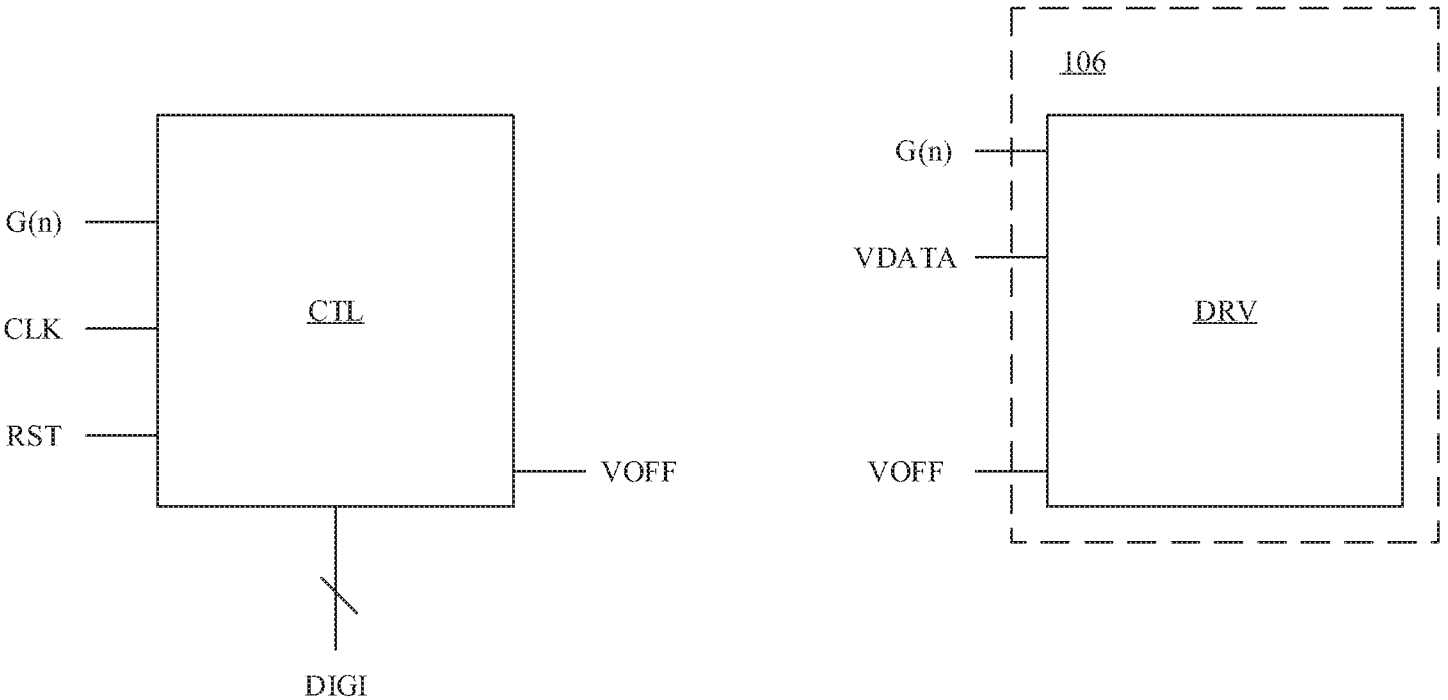
FIG. 7 illustrates a schematic view of a control circuit and a driving circuit according to another embodiment of the present invention.

Refer to FIG. 7. In one embodiment of the present invention, the control circuit CTL may be disposed outside the pixel circuits 106. For example, the control circuit CTL may be disposed in the source drive circuit 120 or at other locations in the display device 100. In this embodiment, the pixel circuit 106 includes the driving circuit DRV but does not include the control circuit CTL (contrary to the embodiment shown in FIG. 2). In addition, in these embodiments, one of the data signals D(1), . . . , D(M) may include the data voltage VDATA and the stop signal, but does not include the digital signal DIGI (contrary to the embodiment shown in FIG. 2).

The present invention has been disclosed by the embodiments described above. However, those embodiments are not intended to limit the present invention. It is apparent to those skilled in the art that various modifications and variations can be made in the present invention without departing from the scope or spirit of the invention. The scope of the present invention should be defined according to the appended claims.

What is claimed is:

1. A display device, comprising:

a driving circuit configured to receive a data voltage in response to a scanning signal, and control brightness of a light emitting element based on the data voltage; and a control circuit configured to provide a stop signal to the driving circuit in response to a digital signal and the scanning signal, so as to stop the light emitting element from emitting light, and in turn control the light emission period of the light emitting element.

2. The display device of claim 1, wherein the control circuit determines the timing for the stop signal to be provided to the driving circuit based on the digital signal and the scanning signal.

3. The display device of claim 1, wherein the control circuit performs counting operation based on a clock signal, so as to determine the timing for the stop signal to be provided to the driving circuit.

4. The display device of claim 1, wherein the control circuit starts counting based on the scanning signal, so as to determine the timing for the stop signal to be provided to the driving circuit.

5. The display device of claim 1, wherein the control circuit determines an initial counting value based on the digital signal, so as to determine the timing for the stop signal to be provided to the driving circuit.

6. The display device of claim 1, wherein the control circuit loads the digital signal based on the scanning signal, and performs counting operation based on the loaded digital signal, so as to determine the timing for the stop signal to be provided to the driving circuit.

7. The display device of claim 1, wherein the control circuit comprises:

a counting circuit configured to load the digital signal and perform counting operation based on the digital signal to generate a counting signal; and an output circuit configured to determine whether to generate the stop signal based on the counting signal.

8. The display device of claim 7, wherein the counting circuit comprises:

a plurality of flip-flops; and a plurality of impulse generating circuits connected in series staggeredly to the flip-flops.

9. The display device of claim 8, wherein the counting signal received by the output circuit comprises an output signal generated respectively by the flip-flops.

10. The display device of claim 8, wherein the control circuit is further configured to provide a disable signal to the flip-flops based on the scanning signal.

11. The display device of claim 8, wherein the control circuit is further configured to provide a disable signal to the flip-flops based on the stop signal.

12. The display device of claim 8, wherein the control circuit further comprises:

a setting circuit configured to provide a plurality of bits of the digital signal to the flip-flops.

13. The display device of claim 12, wherein the setting circuit comprises:

a plurality of first switches, wherein a first terminal of each of the first switches is electrically connected to the flip-flops, a second terminal of each of the first switches is configured to respectively receive one of the plurality of bits of the digital signal, and a control terminal of each of the first switches is configured to receive the scanning signal.

14. The display device of claim 12, wherein the setting circuit comprises:

a plurality of second switches, wherein a first terminal of each of the second switches is electrically connected to the flip-flops, a second terminal of each of the second switches is configured to receive a disable signal, and a control terminal of each of the second switches is configured to receive the scanning signal.

15. The display device of claim 12, wherein the setting circuit comprises:

a plurality of third switches, wherein a first terminal of each of the third switches is electrically connected to the flip-flops, a second terminal of each of the third switches is configured to receive the stop signal, and a control terminal of each of the third switches is configured to receive the scanning signal.

16. The display device of claim 7, wherein the output circuit is further configured to determine, in response to the counting signal, whether to stop the counting circuit from receiving a clock signal.

17. A display device, comprising:

a light emitting element;

a driving element electrically connected to an anode or a cathode of the light emitting element;

a data switch electrically connected between a control terminal of the driving element and a data input terminal;

a stop switch electrically connected between the control terminal of the driving element and a reset input terminal;

a counting circuit, wherein one or more input terminals of the counting circuit are electrically connected to one or more digital signal input terminals; and an output circuit, wherein one or more input terminals of the output circuit are electrically connected to one or more output terminals of the counting circuit, and an output terminal of the output circuit is electrically connected to a control terminal of the stop switch.

18. The display device of claim 17, further comprising:

one or more first switches, wherein the one or more first switches are electrically connected between one or more bit signal input terminals and the one or more input terminals of the counting circuit, and control terminals of the one or more first switches are electrically connected to a scanning signal input terminal.

19. The display device of claim 17, further comprising:

one or more second switches, wherein the one or more second switches are electrically connected between a disable signal input terminal and the one or more input terminals of the counting circuit, and control terminals of the one or more second switches are electrically connected to a scanning signal input terminal.

20. The display device of claim 17, further comprising:

one or more third switches, wherein the one or more third switches are electrically connected between a disable signal input terminal and the one or more input terminals of the counting circuit, and control terminals of the one or more third switches are electrically connected to an output terminal of the output circuit.

* * * * *